US006098748A

United States Patent [19]

Harper, Jr. et al.

[11] Patent Number: 6,098,748

[45] Date of Patent: Aug. 8, 2000

[54] ADJUSTABLE HEIGHT TOOL BIN SYSTEM

[76] Inventors: Robert W. Harper, Jr., P.O. Box 20482, Sedona, Ariz. 86341; Tammy J. Harper, 1602 E. Ocotillo Rd., Apt. 223, Phoenix, Ariz. 85016

[21] Appl. No.: 09/182,962

[22] Filed: Oct. 30, 1998

[51] Int. Cl.[7] ..... E04G 1/00; E04G 3/00; B65D 85/28

[52] U.S. Cl. ..... 182/129; 206/372; 206/373

[58] Field of Search ..... 182/129; 248/210, 248/238; 224/162, 679, 240; 254/217; 410/100, 103; D6/521, 520; 206/229, 373, 372; 211/59.1, 86.01, 89.01

[56] References Cited

U.S. PATENT DOCUMENTS

| | | | |
|---|---|---|---|
| D. 277,622 | 2/1985 | Servadio | D6/520 |
| 2,911,133 | 11/1959 | Ruggieri | 182/129 |
| 5,505,302 | 4/1996 | Ferley | 182/129 X |
| 5,549,429 | 8/1996 | Sergent | 410/100 X |
| 5,597,081 | 1/1997 | Shirley | 212/299 |
| 5,603,405 | 2/1997 | Smith | 182/129 X |
| 5,740,883 | 4/1998 | Trank | 182/129 |

*Primary Examiner*—Daniel P. Stodola
*Assistant Examiner*—Hugh B. Thompson
*Attorney, Agent, or Firm*—Schmeiser, Olsen & Watts; Jared S. Goff

[57] ABSTRACT

An adjustable height tool bin system for self-supportive ladders includes an adjustable length strap allowing positioning of the tool bin at any height between the top and bottom of the ladder. Thus, the position of the present invention is independent of the ladder rungs and ladder platforms, allowing more freedom in placement of the tool bin system. The system also includes an attachable roll towel rack, a winding spool, a utility tray, a hook, a tool rack, and bin dividers each of which may be attached to the tool bin or the strap.

9 Claims, 8 Drawing Sheets

ADJUSTABLE HEIGHT TOOL BIN SYSTEM

BACKGROUND OF THE INVENTION

1. Technical Field

This invention relates to the field of toolboxes. More specifically, the invention relates to a tool bin system that adjustably mounts on a stepladder and can be modified by the addition of components that provide expanded and customized tool holding capacity.

2. Background Art

Various conventional devices relate to tool bins or holders. Examples of patents pertinent to the present invention include:

U.S. Pat. No. 5,727,649 to Buckley for a ladder supportable tool storage container;

U.S. Pat. No. 5,673,885 to Pham for a paint tray for a stepladder;

U.S. Pat. No. 5,649,623 to Kornblatt for a ladder mounted tool belt carrier;

U.S. Pat. No. 5,547,080 to Klimas for a suspendable toolbox;

U.S. Pat. No. 5,305,977 to Roth for a ladder paint bucket holder;

U.S. Pat. No. 5,052,581 to Christ et al. for a ladder-supported holding tray;

U.S. Pat. No. 5,031,723 to Hooten for a ladder accessory;

U.S. Pat. No. 4,953,736 to Magnotto for a paint splatter box;

U.S. Pat. No. 4,869,344 to Peterson for a wire storage construction for ladders; and U.S. Pat. No. 768,364 to Hines for a painter's appliance, each of which is herein incorporated by reference for its pertinent and supportive teachings.

Common problems exist among the aforementioned patent references. Typically, it is not possible to adjust the toolbox or bin height position on a stepladder since the box or bin is often fixed in place. Other times, it is possible to adjust the height of the toolbox, but it can only be positioned at or attached to steps on the stepladder. When a toolbox or bin must be positioned at or attached to a step, then a limited number of height choices exist for a given ladder. A user has no alternative but to select a height position for the toolbox or bin as determined by the available steps. That is, a toolbox or bin cannot be positioned between steps when such a need arises. This problem exists with all sizes of stepladders, however, it is especially troublesome on a tall stepladder such as one ten or more feet high. Serious accidents may occur on tall stepladders if a toolbox is improperly positioned away from the location where work is being performed. A user may be tempted to overreach while retrieving tools and lose balance on the ladder.

Another problem with the above references is that they do not describe any devices for attaching commonly needed items, such as paper towels, to the ladder. This problem is especially troublesome when washing windows or cleaning ceiling lamps. Typically, a user will lay the roll of paper towels on the top of the tool box or ladder. When a user needs a towel piece two hands are required, otherwise, the user risks knocking the toweling onto the floor.

A further problem with the cited references is that they do not describe any devices for holding electric wire, electric cords, light strings, rope, etc. on a toolbox or bin. Typically, the user will lay a rolled up length of such material in the toolbox and untangle or unwind sections with both hands.

The untangling/unwinding activity can be cumbersome and risks knocking the length of material out of the toolbox. In addition, when the ladder is moved, the rolled up material must be carried to the bottom of the ladder, moved to the new position for the ladder and then the ladder moved separately. Some users may attempt to move both the ladder and the rolled material at the same time. However, this effort usually results in dropping such material off of the ladder or the material getting tangled in the ladder while the ladder is being moved.

Therefore, there exists a need to provide a new mechanism to attach tools to a stepladder. Specifically, there is a need for a mechanism to attach a toolbox to a stepladder that allows unlimited attachment heights. There is also a need for a mechanism to hold paper towel rolls on an elevated toolbox. Moreover, there is a need for a mechanism that can mount loose light strings, spools of wire, rope, electric cords, etc. to the stepladder and allow for easy unwinding therefrom. These, and other identified needs, are satisfied by the present invention.

DISCLOSURE OF INVENTION

According to the present invention, a tool bin system is provided comprising: a tool bin; at least one strap attached to the tool bin and adapted to form a loop around a stepladder, securing the tool bin against the stepladder; and a buckle mechanism attached to the strap and adapted to provide adjustment of the loop circumference, wherein a change in loop circumference produces a change in vertical position of the tool bin on the stepladder. By way of example, the tool bin system may additionally comprise a roll towel rack for holding paper towel rolls and the like, such as cloth towel rolls, and a rack clip for mounting the roll towel rack on the tool bin or strap. Additionally, a winding spool and a spool clip for mounting the winding spool on the tool bin or strap may also be provided. The winding spool may further include a means for mounting a pre-wound roll of material on the spindle without unwinding the pre-wound roll. Further, multiple accessories are provided, each having an accessory clip for mounting on the tool bin or strap. Such accessories include a utility tray, a hook, a tool rack, and adjustable tool bin dividers.

The foregoing and other features and advantages of the present invention will be apparent from the following more particular description of preferred embodiments of the invention, as illustrated in the accompanying drawings.

BRIEF DESCRIPTION OF DRAWINGS

Preferred embodiments of the present invention will hereinafter be described in conjunction with the appended drawings, where like designations denote like elements, and.

BEST MODE FOR CARRYING OUT THE INVENTION

Figure 1:
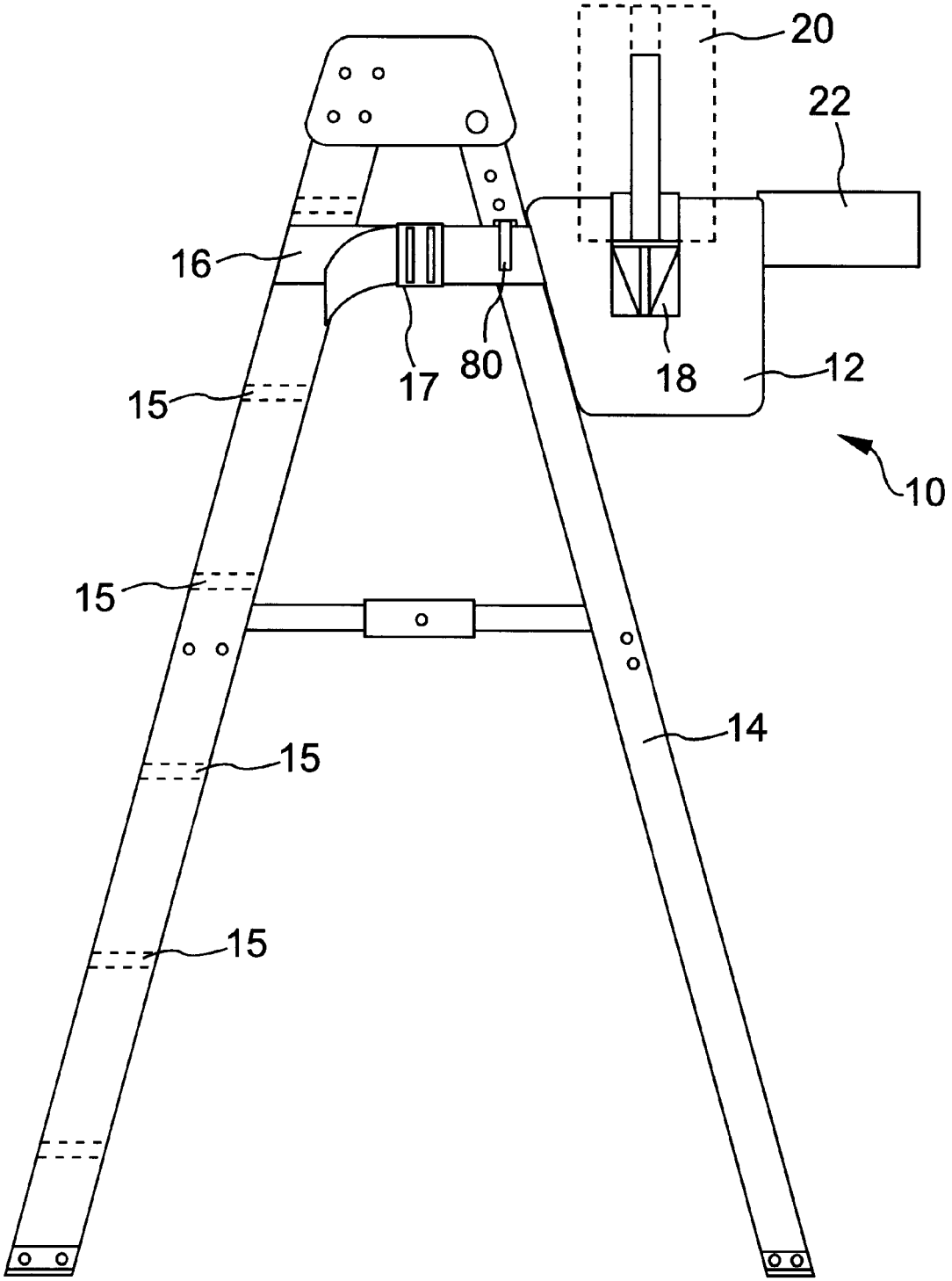
FIG. 1 is a side view of a stepladder having a portion of the tool bin system mounted thereon.

According to a preferred embodiment of the present invention, an adjustable height tool bin system is provided. One preferred feature of the invention is an adjustable length strap. Because the tool bin system is designed for use with a stepladder, the adjustable strap allows positioning of the tool bin at any height between the top and bottom of the ladder. That is, the position is not fixed in one location as with some of the conventional devices discussed previously. Also, the position of the present invention is independent of the ladder rungs allowing more freedom in placement of the tool bin system. In some of the conventional devices discussed previously, the position of the device may be adjusted, but the position is dependent on the location of the ladder rungs. Another preferred feature of the invention is an attachable roll towel rack. The roll towel rack keeps roll towels readily accessible during tasks such as washing windows and dusting lights or shelves. Yet another preferred feature of the invention is an attachable winding spool. The winding spool allows easy winding and unwinding of strings of electric lights, power cords, rope, etc. With the winding spool, such items can be stored in an orderly way on the spool and unwound with ease during installation or use. When the ladder is moved, the spool turns to release additional lengths of the item stored thereon. The winding spool handle allows easy rewinding of the item after use. This feature is especially useful for installing and taking down holiday light strings. Other preferred features of the present invention include: a utility tray, a hook, a tool rack, and adjustable bin dividers, each of which may be attached to the tool bin or the strap.

A tool bin system according to the preferred embodiments of the present invention improves access to tools during activities such as washing windows, hanging light strings, painting, etc. Also, safety is improved since there is no need to hold tools while attempting to climb or move a ladder. Additionally, the invention reduces the often cumbersome nature of doing work on a ladder, since the tools and ladder can be moved simultaneously. Finally, the present invention is adaptable to various types of stepladders, including old ladders with different types of rungs, hinges, and brackets compared to current ladders. That is, conventional devices such as those discussed previously are typically tailored to work with ladders having a certain type of structural component, for example, hollow ladder rungs, paint can trays built into the ladder, etc. If the particular component is not present on a particular ladder, then many of the conventional devices cannot be used. A new style of fold-up stepladder, for example, does not include a paint can tray because it may interfere with the folding mechanism. The preferred embodiments of the present invention may be used in conjunction with almost any self-supportive ladder, for example stepladders or fold-up stepladders. As long as the strap of the present tool bin system can be looped around the self-supportive ladder, the tool bin system according to the present invention is compatible. No special ladder rungs or paint can trays need be present.

The present invention involves a tool bin system designed to adjustably mount on any self-supportive ladder, for example a stepladder, and to be easily modified by the addition of accessories, such as tool holders. Referring to FIG. 1, a side view is shown of stepladder 14, having a portion of a tool bin system 10 mounted thereon, and ladder steps 15 located on one side thereof. The portion of tool bin system 10 shown includes a tool bin 12 with a roll towel rack 18 mounted thereon for holding paper towel roll 20 and the like, such as cloth roll towels. Additionally, utility tray 22 is mounted on tool bin 12 and hook 80 is mounted to an adjustable strap 16. Tool bin 12 is mounted on stepladder 14 using adjustable strap 16. In operation, strap 16 loops around ladder 14 and can be positioned at any height on ladder 14, up or down from the position shown. Repositioning occurs by changing the circumference of the loop formed by strap 16. To lower tool bin 12 a larger loop circumference than shown would be selected and a smaller loop circumference could be selected to raise tool bin 12.

Figure 9:
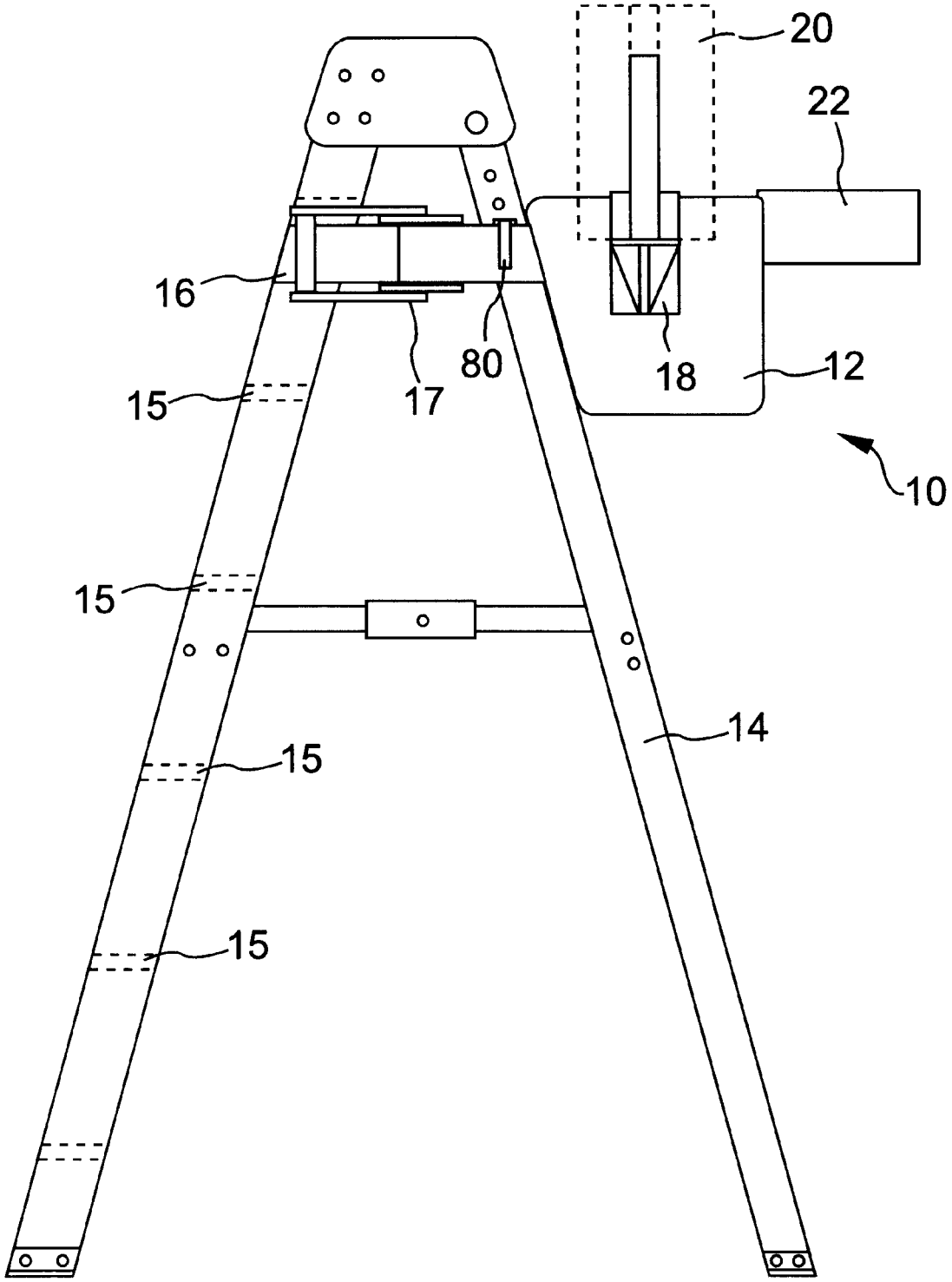
FIG. 9 is a side view of a stepladder having a portion of the tool bin system mounted thereon, wherein the buckle mechanism is a ratchet device.
Figure 10:
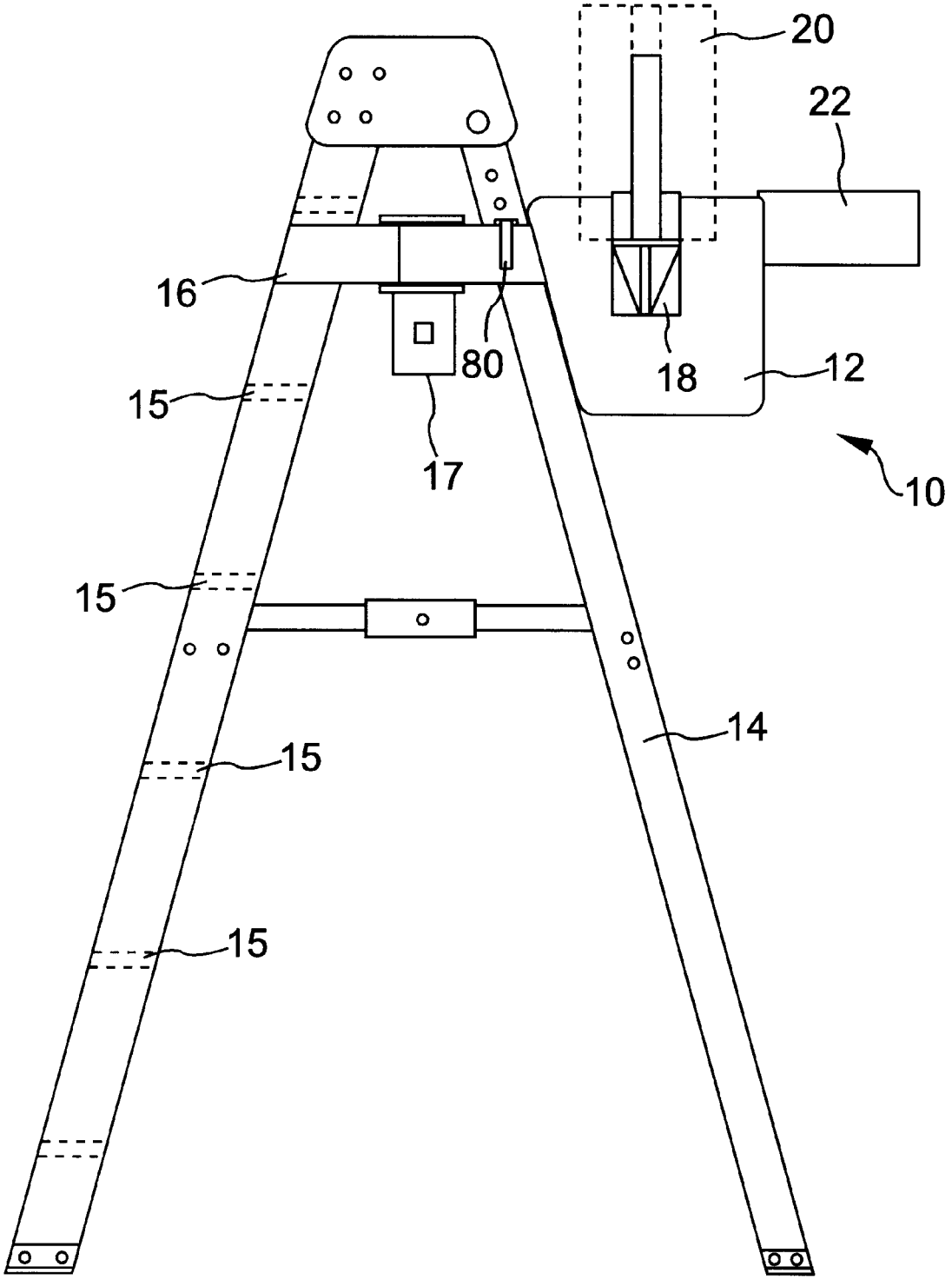
FIG. 10 is a side view of a stepladder having a portion of the tool bin system mounted thereon, wherein the buckle mechanism is a motorized winch.

Buckle mechanism 17 is attached to strap 16 and provides adjustment of the loop circumference of strap 16. Buckle mechanism 17 also grips strap 16 to prevent unwanted loosening once a desired loop circumference is established. Many attachment means are suitable for buckle mechanism 17, including most types of buckles, clasps, hook-and-eye connectors, etc. However, buckle mechanism 17 preferably allows loosening and tightening of strap 16 without opening the loop around ladder 14. That is, some buckle mechanisms 17 must be disengaged from strap 16 before loosening or tightening. Such a requirement is not preferred since it creates an opportunity for tool bin 12 to fall to the floor from its selected position. Also, buckle mechanism 17 preferably allows for one-handed loosening of the strap and one-handed tightening of the strap. For example, buckle mechanism 17 may be a cinching device that grips the strap to maintain a selected loop circumference, but a portion of the strap may be pulled through the cinching device to change the loop circumference. When buckle mechanism 17 is a cinching device, it may be more preferable that strap 16 comprise a single strap with each end secured to the tool bin. The cinching device could thus be positioned on strap 16 to provide changing of the loop circumference. Yet, if the cinching device was released, then tool bin 12 could be limited in the distance it would drop by the maximum loop circumference of the single strap. Buckle mechanism 17 may be also be a rachet device capable of decreasing and increasing the loop circumference by manipulation of a crank handle (See FIG. 9). The gear arrangement in a rachet device adapted to the present invention would provide for incremental loosening and tightening of strap 16, preferably with one hand. Buckle mechanism 17 may also be a motorized winch that operates similarly to the ratchet device (See FIG. 10).

Figure 2:
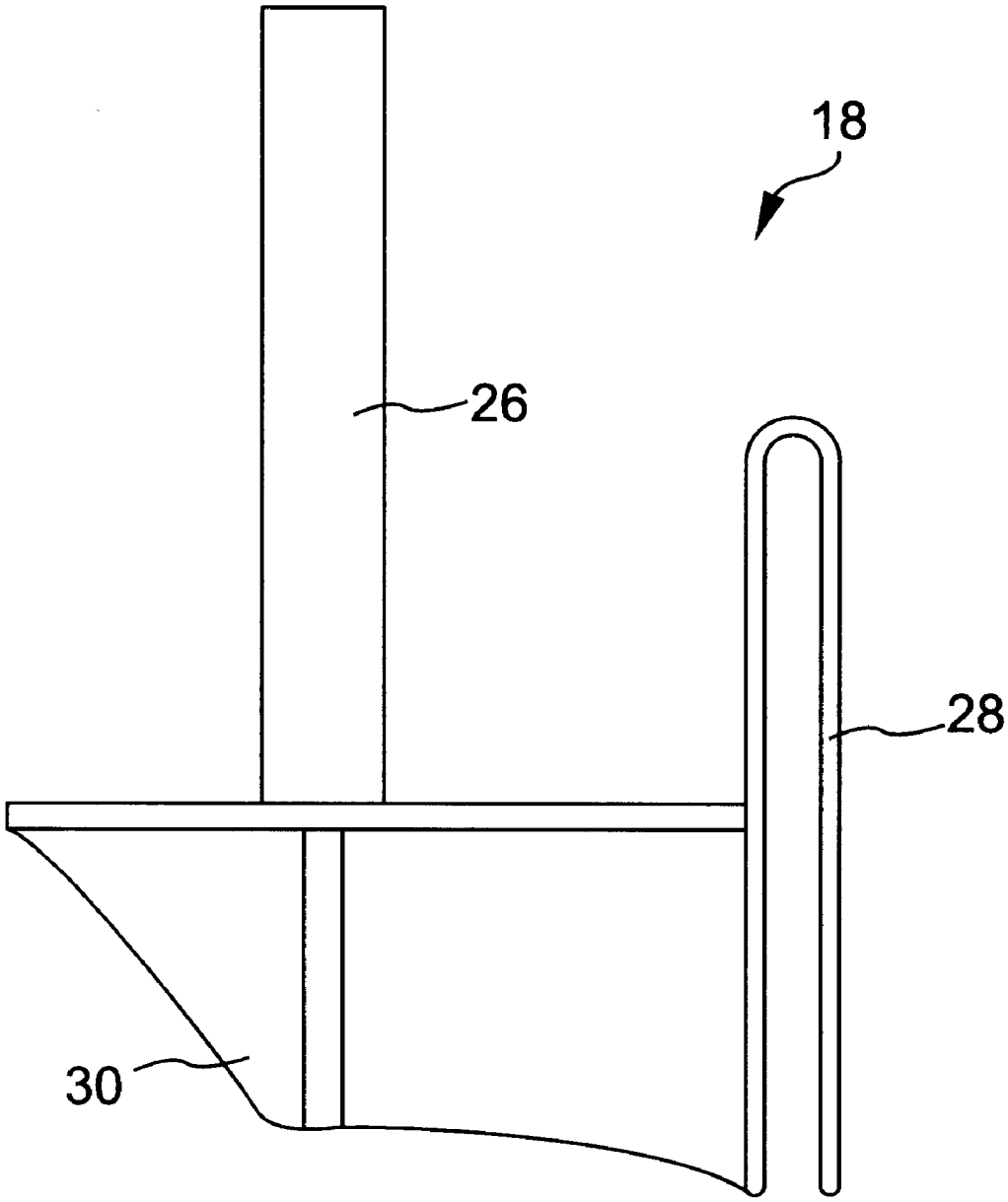
FIG. 2 is a side view of an attachable roll towel rack from FIG. 1.
Figure 3:
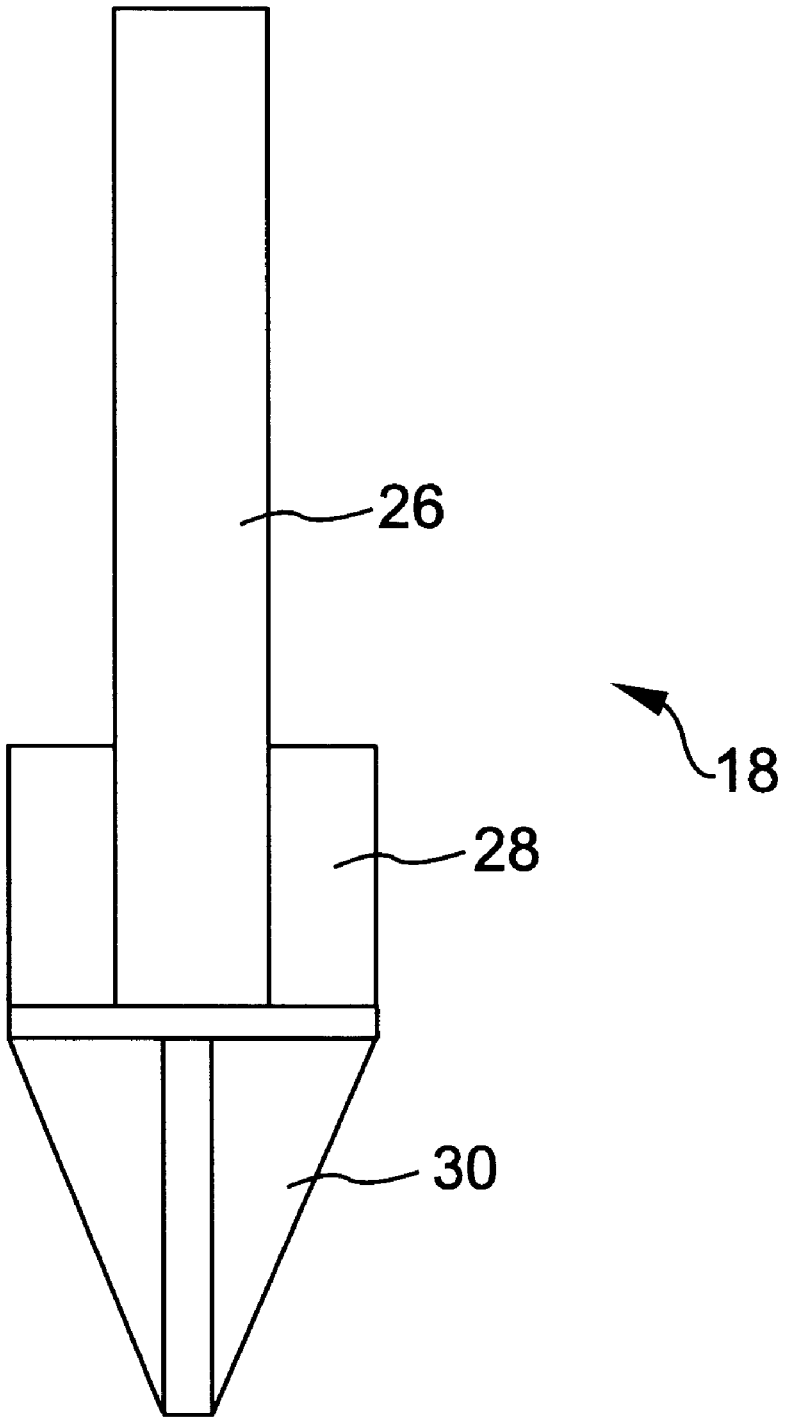
FIG. 3 is a front view of the roll towel rack in FIG. 2.

Referring to FIGS. 2 and 3, a side and front view of the attachable roll towel rack 18 from FIG. 1 is shown. Roll towel rack 18 has a vertical pole 26, clip 28 and support base 30. In operation, clip 28 is mounted onto tool bin 12 and a paper towel roll 20 (in FIG. 1) is slipped over pole 26, thus allowing for easy one-handed removal of towel sheets at any height desired.

Figure 4:
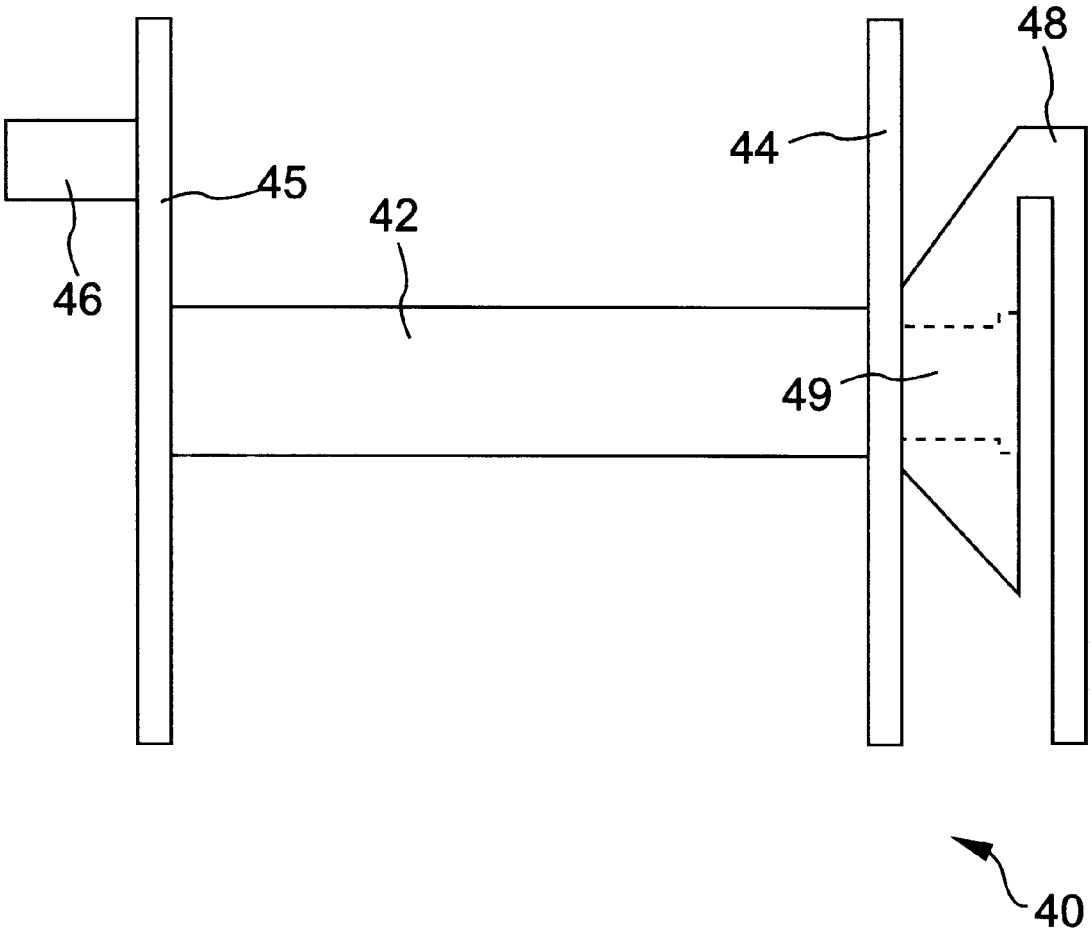
FIG. 4 is a view of a winding spool or reel.

Referring to FIG. 4, a winding spool or reel 40 is shown including a central spindle 42 having circular plates 44, 45 mounted at either end, as illustrated. Outer plate 45 has a crank handle 46 mounted thereon allowing a user to rotate central spindle 42 and wind or unwind material stored on winding spool or reel 40. Attachment mechanism 49 is releaseable and rotatable and designed to secure clip 48, yet allow rotation of central spindle 42 without binding. A variety of known mechanisms may be used to accomplish the function of attachment mechanism 49. In one preferred embodiment (not shown), a bulb at the end of spindle 42 may be provided that is sufficiently large to be held in a socket formed in clip 48, but sufficiently small to allow the bulb portion to be pulled out of its socket position. More preferably, a mechanism for removing circular plate 44 or outer plate 45 from spindle 42 may allow a user to place a spool of material, for example, electrical wire, onto the spindle and then reassemble winding spool or reel 40. Thus, a pre-wound roll of material may be placed on spindle 42 without unwinding the pre-wound roll.

Figure 5:
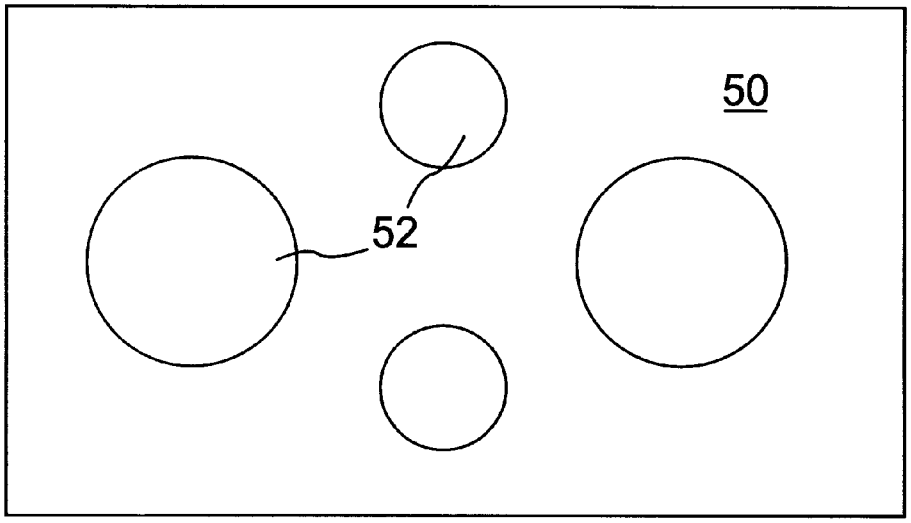
FIG. 5 is a top view of an additional tool rack that is mountable to the tool bin system in FIG. 1.
Figure 6:
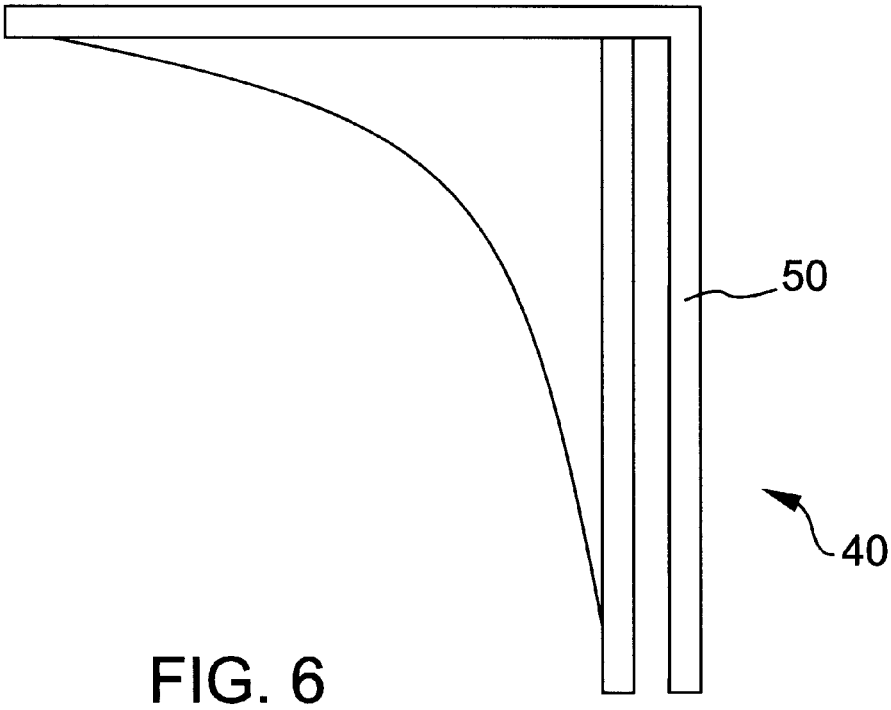
FIG. 6 a side view of the tool rack in FIG. 5.
Figure 7:
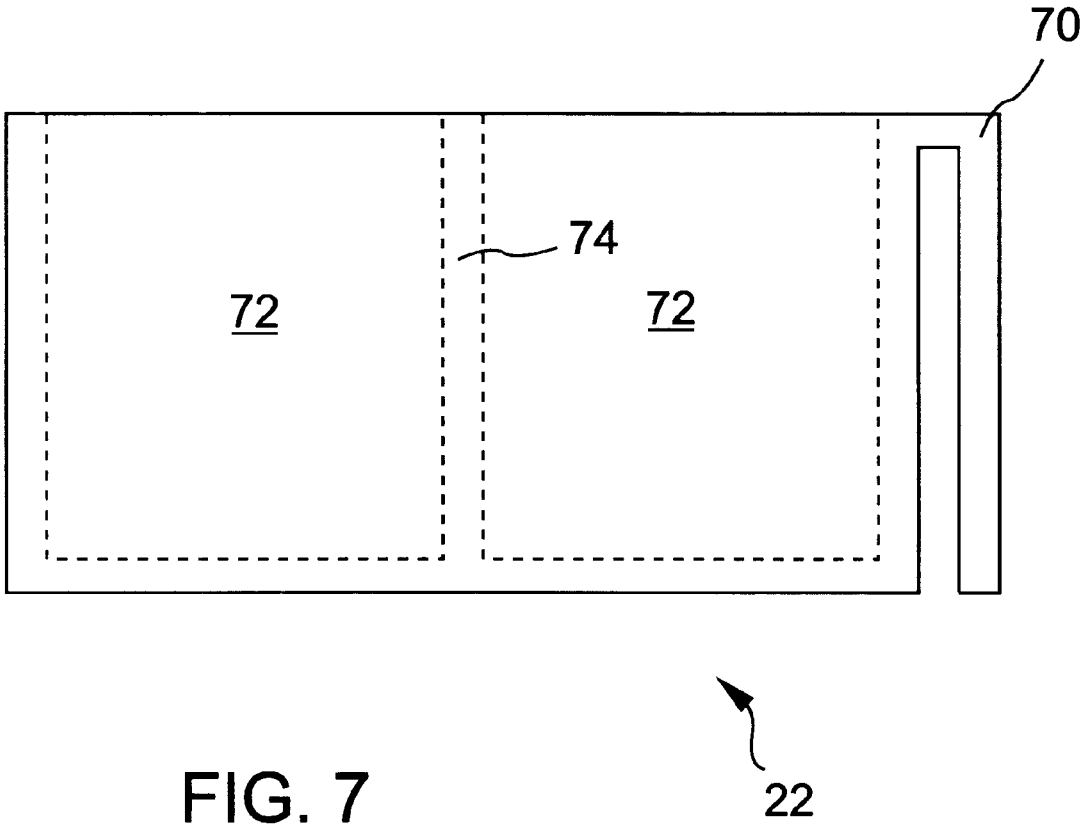
FIG. 7 is a side view of a utility tray shown in FIG. 1.

In FIGS. 5 and 6, a top and side view of an additional tool rack 50 with a shelf design is shown that is attachable to tool bin 12 or strap 16 (shown in FIG. 1). Specifically, there are holes 52 formed therein for retaining tools such as hammers and screwdrivers capable of extending only partially through holes 52. That is, a narrow portion of such tools extend through holes 52, but a wider portion of such tools will not fit through hole 52. Thus, such tools (not shown) are securely hung on tool rack 50 when tool rack 50 is attached with clip 54 to tool bin 12 or strap 16 shown in FIG. 1.

FIG. its a side view of utility tray 22 shown in FIG. 1. Utility tray 22 includes a clip 70 for attaching utility tray 22 to tool bin 12 or strap 16 in FIG. 1 and at least one divider 74 for dividing the storage space in utility tray 22 into a plurality of compartments 72. Dividers 74 can be arranged in a variety of positions to create compartments 72 with a variety of shapes. Accordingly, compartments 72 could be square, rectangular, round, triangular, etc. or a combination of such shapes. Thus, compartments 72 may be shaped to provide tool storage needs for specific tasks. For example, one utility tray 22 could be designed for painting tasks, while another is designed for cleaning tasks, and a third is designed for tasks in building construction. Dividers 74 may be adjustable such that several different arrangements of compartments 72 would be possible. Similarly, dividers, including adjustable dividers, may also be provided in tool bin 12 with the same objective of providing customized tool storage for a variety of tasks.

Figure 8:
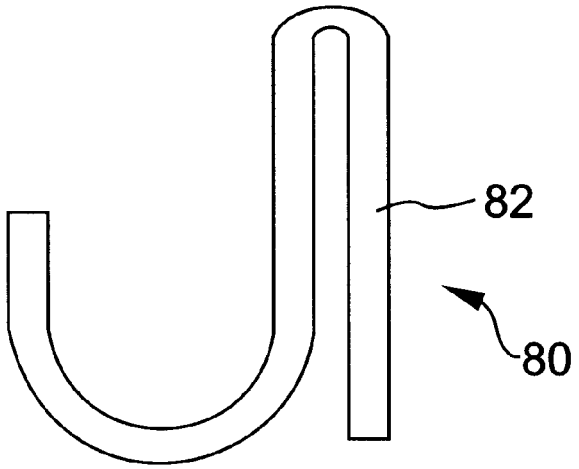
FIG. 8 is a side view of an attachable hook.

FIG. 8 is a side view of an attachable hook 80 including a clip 82 for attaching hook 80 to tool bin 12 or strap 16 in FIG. 1. Hook 80 may be used for hanging a variety of tools or materials within easy reach according to the preferred embodiments of the tool bin system described above.

Referring generally to FIGS. 1–8, one of ordinary skill in the art of designing and using tool bins will realize many advantages from studying and using the preferred embodiment. For example, each clip located on each tool bin accessory is designed to also be mounted onto strap 16. For example, clip 28 on roll towel rack 18 has an U-shape, just like all of the other accessories, which will either fit over the side of tool bin 12 or fit over strap 16. This will allow the user to mount more accessories to tool bin system 10 and not be restricted to mounting accessories only to the tool bin. Of course, one skilled in the art will realize that accessories include, for example, roll towel rack 18, utility tray 22, winding spool 40, tool rack 50, hook 80, etc.

It is noted that a skilled artisan of tool bin systems will realize that strap 16 may be located at any position along the height of the ladder and, in particular, at positions intermediate to steps 15. This arrangement allows a user to select a variety of positions for the tool bin system, including positions between steps. This is especially helpful when using ladders that are five feet and taller to avoid the temptation to overreach when gathering tools from a suspended tool bin. Although the illustrated embodiments discuss the arrangement of tool bin system 10, one skilled in the art will realize that the preferred embodiment has many alternative designs. One variation is the shape of tool bin 12. Although tool bin 12 is illustrated as inclined on one side to accommodate the incline of the stepladder, it is contemplated to have a square tool bin and an adaptor that is angled to hold the tool bin upright and fit securely to ladder 14. By this means, the present invention could even be adapted to existing tool bins or boxes. Also, adaptors could be provided for holding strap 16 in an upright position against ladder 14, rather than at an incline as shown in FIG. 1. Securing strap 16 in an upright position against ladder 14 may be preferred if tool bin 12 is especially heavy when loaded with tools and accessories such that strap 16 tends to slip upward.

While the invention has been particularly shown and described with reference to preferred embodiments thereof, it will be understood by those skilled in the art that various changes in form and details may be made therein without departing from the spirit and scope of the invention. Accordingly, unless otherwise specified, any dimensions of the apparatus indicated in the drawings or herein are given as an example of possible dimensions and not as a limitation.

What is claimed is:

1. A tool bin system comprising:

a self-supportive ladder;

a tool bin having a rigid inclined side in contact with the self-supportive ladder;

at least one strap attached to the tool bin and forming a loop that lies substantially within a substantially horizontal plane, the at least one strap surrounding the self-supportive ladder, the at least one strap thereby securing the tool bin against the self-supportive ladder with the inclined side resting against the self-supportive ladder; and a buckle mechanism attached to the at least one strap and adapted to provide adjustment of the loop circumference, whereby a change in the loop circumference produces a change in vertical position of the tool bin on the self-supportive ladder while the inclined side remains in contact with the self-supportive ladder.

2. The tool bin system of claim 1, wherein the buckle mechanism comprises a clasp joining two ends of the at least one strap, wherein the clasp position on the at least one strap may be varied to change the loop circumference.

3. The tool bin system of claim 1, wherein the at least one strap comprises one strap with two ends, each end being secured to the tool bin, and the buckle mechanism comprises a cinching device that grips the strap to maintain a selected loop circumference, wherein a portion of the strap may be pulled through the cinching device to change the selected loop circumference.

4. The tool bin system of claim 1, wherein the buckle mechanism comprises a rachet device capable of decreasing and increasing the loop circumference by manipulation of a crank handle with one hand.

5. The tool bin system of claim 1, wherein the buckle mechanism comprises a motorized winch capable of decreasing and increasing the loop circumference by activation of an electric motor.

6. The tool bin system of claim 1, further including a roll towel rack and a rack clip for mounting the roll towel rack on the tool bin or the at least one strap.

7. The tool bin system of claim 1, further including a winding spool and a spool clip for mounting the winding spool on the tool bin or the at least one strap.

8. A tool bin system comprising:

a self-supportive ladder a tool bin having a rigid inclined side in contact with the self-supportive ladder;

at least one strap attached to the tool bin and forming a loop that lies substantially within a substantially horizontal plane, the at least one strap surrounding the self-supportive ladder, and the at least one strap thereby securing the tool bin against the self-supportive ladder with the inclined side resting against the self-supportive ladder;

a buckle mechanism attached to the at least one strap and adapted to provide adjustment of the loop circumference, whereby a change in the loop circumference produces a change in vertical position of the tool bin on the self-supportive ladder while the inclined side remains in contact with the self-supportive ladder;

a roll towel rack mounted on one of the tool bin or the at least one strap;

a spindle rotatably mounted on one of the tool bin or the at least one strap;

a plate mounted on an end of the spindle; and a handle mounted on the plate for winding and unwinding materials stored on the spindle.

9. The tool bin system of claim 8, wherein the spindle further comprises a means for mounting a pre-wound roll of material on the spindle without unwinding the pre-wound roll.

* * * * *